US010830512B2

(12) United States Patent
Schroeder

(10) Patent No.: US 10,830,512 B2
(45) Date of Patent: Nov. 10, 2020

(54) REFRIGERATOR APPLIANCES AND SEALED REFRIGERATION SYSTEMS THEREFOR

(71) Applicant: Haier US Appliance Solutions, Inc., Wilmington, DE (US)

(72) Inventor: Michael Goodman Schroeder, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/907,451

(22) Filed: Feb. 28, 2018

(65) Prior Publication Data

US 2019/0264961 A1 Aug. 29, 2019

(51) Int. Cl.
*F25B 39/00* (2006.01)
*F25B 41/00* (2006.01)
(Continued)

(52) U.S. Cl.
CPC ..... *F25B 39/00* (2013.01); *F25B 13/00* (2013.01); *F25B 41/00* (2013.01); *F25D 19/006* (2013.01)

(58) Field of Classification Search
CPC ..... F28F 13/12; F28F 13/125; F28F 13/08; F28F 1/00; F25B 2321/00;
(Continued)

(56) References Cited

U.S. PATENT DOCUMENTS 5,297,623 A * 3/1994 Ogushi ..... F28F 13/125 165/121
6,328,527 B1 12/2001 Comrad et al.
(Continued)

FOREIGN PATENT DOCUMENTS

CN 201772566 U 3/2011
FR 2846033 A1 * 4/2004 ..... F04D 5/001
JP 3205196 B2 9/2001

OTHER PUBLICATIONS

Momen, et al.: Novel Frost Handling Techniques Using Air Bearing Heat Exchangers for Household Refrigerators; ASRAE Annual Conference; Jul. 2015.*
(Continued)

*Primary Examiner* — Tavia Sullens
(74) *Attorney, Agent, or Firm* — Dority & Manning, P.A.

(57) ABSTRACT

A refrigerator, including a sealed refrigeration system, is provided herein. The sealed refrigeration system may include a compressor, a phase separator, and a rotatable heat exchanger. The compressor may compress a refrigerant fluid through the sealed refrigeration system. The phase separator may be in fluid communication with the compressor. The phase separator may include a separator body defining an inner face and an outer face. The inner face may define a refrigerant cavity within the phase separator body. The outer face may be directed away from the refrigerant cavity opposite the inner face. The rotatable heat exchanger may include a thermally conductive body defining a dynamic shear surface directed toward the outer face of the separator body. Moreover, a set fluid gap may be defined between the dynamic shear surface and the outer face.

13 Claims, 4 Drawing Sheets

(51) Int. Cl.
*F25B 13/00* (2006.01)
*F25D 19/00* (2006.01)

(58) Field of Classification Search
CPC ..... F25B 2321/001; F25B 2321/002; F25B 2321/0022; F25B 39/00; F25B 39/02; F25B 13/00; F25B 41/00; F25B 19/00; F25B 19/006; F25B 2400/02; F25B 2400/23; F25B 43/006; F04D 5/00; F04D 5/001; F04D 17/161; H01L 23/467
USPC ..... 415/90; 62/3.1, 3.6, 3.5, 5, 6; 361/697
See application file for complete search history.

(56) References Cited

U.S. PATENT DOCUMENTS

| | | | | |
|---|---|---|---|---|
| 8,161,762 | B2 | 4/2012 | Sugimoto et al. | |
| 8,988,881 | B2 | 3/2015 | Koplow | |
| 2006/0021735 | A1* | 2/2006 | Lopatinsky ..... | H01L 23/467 165/80.3 |
| 2010/0177480 | A1 | 7/2010 | Koplow | |
| 2011/0103011 | A1 | 5/2011 | Koplow | |

OTHER PUBLICATIONS

Johnson et al.: Development and Evaluation of a Sandia Cooler-based Refrigerator Condenser; Sandia National Laboratories; Jul. 2015.*

Koplow: A Fundamentally New Approach to Air-cooled Heat Exchangers: Sandia National Laboratories; Jan. 2010.*

* cited by examiner

REFRIGERATOR APPLIANCES AND SEALED REFRIGERATION SYSTEMS THEREFOR

FIELD OF THE INVENTION

The present subject matter relates generally to sealed refrigeration systems and refrigerator appliances including one or more sealed refrigeration systems.

BACKGROUND OF THE INVENTION

Various assemblies or appliances make use of one or more sealed refrigeration systems to cool portions of the assembly or appliance. For instance, refrigerator appliances generally include a cabinet that defines a chilled chamber that is often cooled with a sealed refrigeration system. Such sealed refrigeration systems may include one or more phase-separator elements, such as a condenser or an evaporator. Heat-exchange features are commonly included with the phase-separator elements to improve the performance of the phase-separator elements. For instance, some existing evaporators incorporate multiple static blades to conduct heat between an ambient environment and a refrigerant fluid flowing through the sealed refrigeration system.

The efficacy and efficiency of a sealed refrigeration system may be, at least in part, contingent on the amount of heat that can be exchanged at the phase-separator elements. However, many existing systems struggle to consistently exchange adequate amounts of heat to/from the phase-separator elements. Moreover, certain systems, such as those utilizing multiple static blades to improve heat exchange, require significant amounts of space in order for their corresponding heat-exchange features to be effective. These size constraints can limit the usability of the overall apparatus or appliance. For instance, in the case of refrigerator appliances, the increased space needed for the heat-exchange elements naturally limits the potential size of other portions of the appliance, such as the chilled chamber.

Therefore, there is a need for further improvements to sealed refrigeration systems. In particular, it would be advantageous to provide a sealed refrigeration system having one or more features for efficiently and effectively drawing heat to or from a phase separator while requiring relatively little additional space.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a sealed refrigeration system is provided. The sealed refrigeration system may include a compressor, a phase separator, and a rotatable heat exchanger. The compressor may compress a refrigerant fluid through the sealed refrigeration system. The phase separator may be in fluid communication with the compressor. The phase separator may include a separator body defining an inner face and an outer face. The inner face may define a refrigerant cavity within the phase separator body. The outer face may be directed away from the refrigerant cavity opposite the inner face. The rotatable heat exchanger may include a thermally conductive body defining a dynamic shear surface directed toward the outer face of the separator body. Moreover, a set fluid gap may be defined between the dynamic shear surface and the outer face.

In another exemplary aspect of the present disclosure, a sealed refrigeration system is provided. The sealed refrigeration system may include a compressor, a phase separator, and a rotatable heat exchanger. The compressor may compress a refrigerant fluid through the sealed refrigeration system. The phase separator may be in fluid communication with the compressor. The phase separator may include a separator body defining an inner face and an outer face. The inner face may define a refrigerant cavity within the phase separator body. The outer face may be directed away from the refrigerant cavity opposite the inner face. The rotatable heat exchanger may include a thermally conductive body defining a dynamic shear surface directed toward the outer face of the separator body. Moreover, a set fluid gap may be defined between the dynamic shear surface and the outer face. Furthermore, the rotatable heat exchanger may also include a plurality of fins extending outward as a plurality of fan blades from the thermally conductive body and away from the set fluid gap.

In yet another exemplary aspect of the present disclosure, refrigerator appliance is provided. The refrigerator appliance may include a cabinet defining a chilled chamber and a sealed refrigeration system mounted to the cabinet to cool the chilled chamber. The sealed refrigeration system may include a compressor, a phase separator, and a rotatable heat exchanger. The compressor may compress a refrigerant fluid through the sealed refrigeration system. The phase separator may be in fluid communication with the compressor. The phase separator may include a separator body defining an inner face and an outer face. The inner face may define a refrigerant cavity within the phase separator body. The outer face may be directed away from the refrigerant cavity opposite the inner face. The rotatable heat exchanger may include a thermally conductive body defining a dynamic shear surface directed toward the outer face of the separator body. Moreover, a set fluid gap may be defined between the dynamic shear surface and the outer face.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
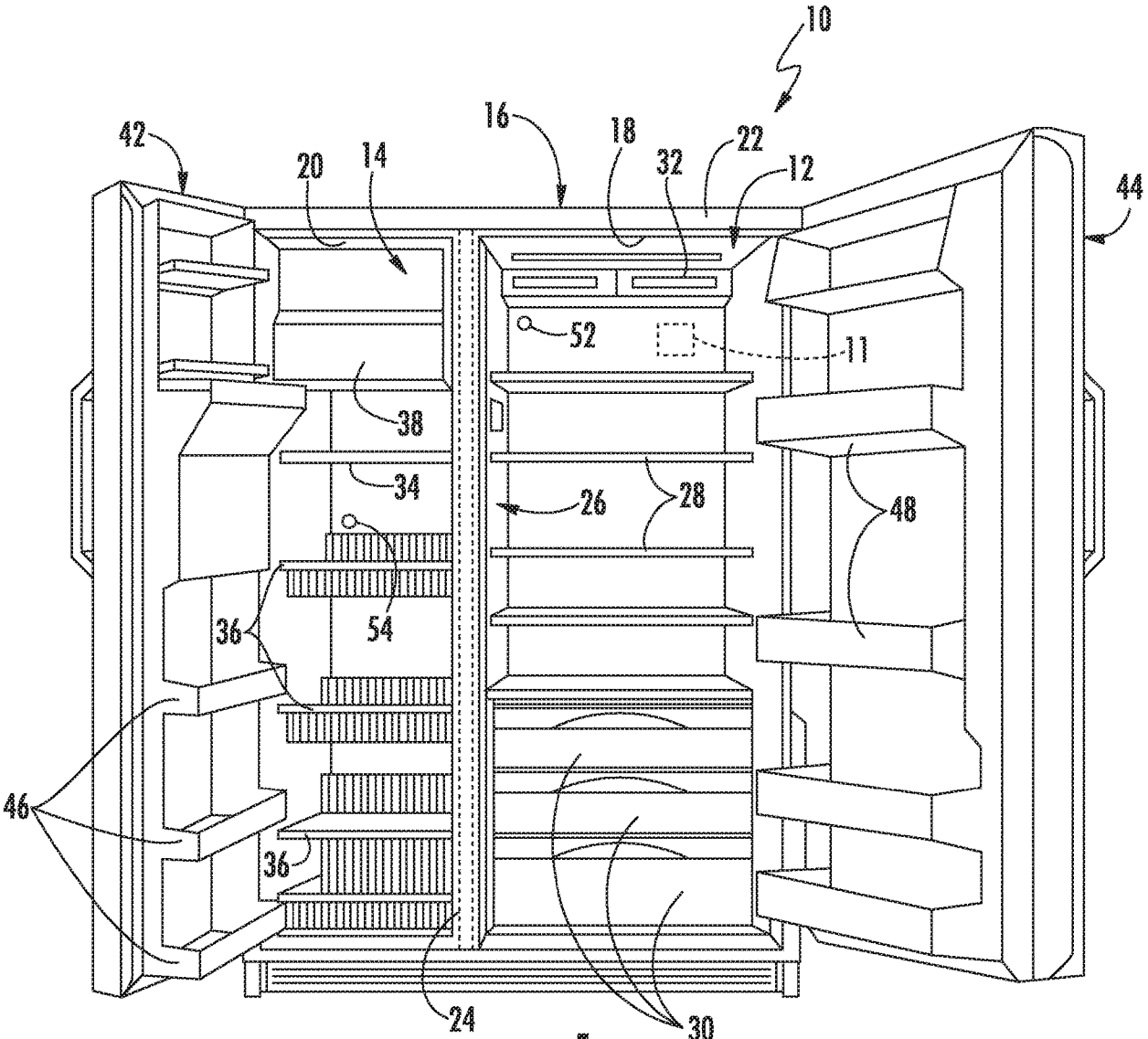
FIG. 1 provides a front perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Furthermore, as used herein, terms of approximation, such as "approximately," "substantially," or "about," refer to being within a ten percent margin of error.

Generally, the present disclosure provides a sealed refrigeration system for use in, as an example, a refrigerator appliance. The sealed refrigeration system may assist or control cooling in the refrigerator appliance and may include one or more active rotating heat exchangers that maintain a set fluid gap relative to a phase separator.

FIG. 1 provides a front view of a representative refrigerator appliance 10 according to exemplary embodiments of the present disclosure. More specifically, for illustrative purposes, the present disclosure is described with a refrigerator appliance 10 having a construction as shown and described further below. As used herein, a refrigerator appliance includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that the configuration shown in FIG. 1 is by way of example only.

Refrigerator appliance 10 includes a fresh food storage compartment 12 and a freezer storage compartment 14. In some embodiments, freezer compartment 14 and fresh food compartment 12 are arranged side-by-side within an outer case 16 and defined by inner liners 18 and 20 therein. A space between case 16 and liners 18, 20 and between liners 18, 20 may be filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

Refrigerator appliance 10 can be operated by one or more controllers 11 or other processing devices according to programming or user preference via manipulation of a control interface 32 mounted (e.g., in an upper region of fresh food storage compartment 12 and connected with controller 11). Controller 11 may include one or more memory devices (e.g., non-transitive memory) and one or more microprocessors, such as a general or special purpose microprocessor operable to execute programming instructions or micro-control code associated with the operation of the refrigerator appliance 10. The memory may represent random access memory such as DRAM, or read only memory such as ROM or FLASH. In one embodiment, the processor executes programming instructions stored in memory. The memory may be a separate component from the processor or may be included onboard within the processor. Controller 11 may include one or more proportional-integral ("PI") controllers programmed, equipped, or configured to operate the refrigerator appliance according to various control methods. Accordingly, as used herein, "controller" includes the singular and plural forms.

Controller 11 may be positioned in a variety of locations throughout refrigerator appliance 10. In the illustrated embodiment, controller 11 may be located, for example, behind an interface panel 32 or doors 42 or 44. Input/output ("I/O") signals may be routed between the control system and various operational components of refrigerator appliance 10 along wiring harnesses that may be routed through, for example, the back, sides, or mullion 26. Typically, through user interface panel 32, a user may select various operational features and modes and monitor the operation of refrigerator appliance 10. In one embodiment, the user interface panel 32 may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. User interface panel 32 may be in communication with controller 11 via one or more signal lines or shared communication busses.

In some embodiments, one or more temperature sensors are provided to measure the temperature in the fresh food compartment 12 and the temperature in the freezer compartment 14. For example, first temperature sensor 52 may be disposed in the fresh food compartment 12 and may measure the temperature in the fresh food compartment 12. Second temperature sensor 54 may be disposed in the freezer compartment 14 and may measure the temperature in the freezer compartment 14. This temperature information can be provided (e.g., to controller 11 for use in operating refrigerator 10). These temperature measurements may be taken intermittently or continuously during operation of the appliance or execution of a control system.

Optionally, a shelf 34 and wire baskets 36 may be provided in freezer compartment 14. Additionally or alternatively, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. In alternative embodiments, one or both doors 42, 44 may be slidable or otherwise movable between open and closed positions. Freezer door 42 includes a plurality of storage shelves 46, and fresh food door 44 includes a plurality of storage shelves 48.

Figure 2:
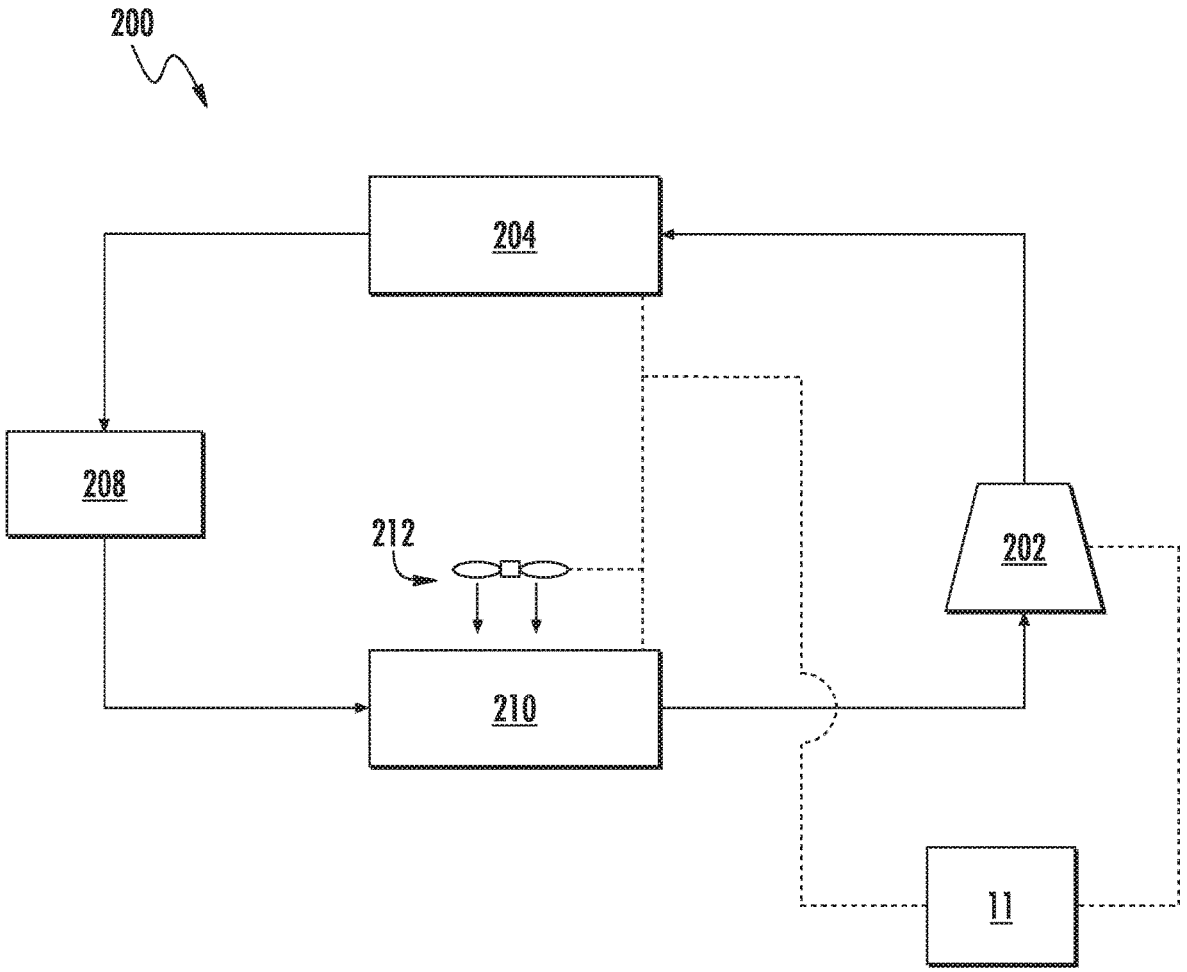
FIG. 2 provides a schematic view of various components of the exemplary embodiments of FIG. 1.

Referring now to FIG. 2, refrigerator appliance 10 may include a refrigeration system 200. In general, refrigeration system 200 is charged with a refrigerant that is flowed through various components and facilitates cooling of the fresh food compartment 12 and the freezer compartment 14. Refrigeration system 200 may be charged or filled with any suitable refrigerant. For example, refrigeration system 200 may be charged with a flammable refrigerant, such as R441A, R600a, isobutene, isobutane, etc.

Refrigeration system 200 includes a compressor 202 for compressing the refrigerant, thus raising the temperature and pressure of the refrigerant. Compressor 202 may for example be a variable speed compressor, such that the speed of the compressor 202 can be varied between zero (0) and one hundred (100) percent by controller 11. Refrigeration system 200 may further include a condenser 204 (e.g., a first phase separator), which may be disposed downstream of compressor 202 in the direction of flow of the refrigerant. Thus, condenser 204 may receive refrigerant from the compressor 202, and may condense the refrigerant by lowering the temperature of the refrigerant flowing therethrough due to, for example, heat exchange with ambient air).

Refrigeration system 200 further includes an evaporator 210 (e.g., a second phase separator) disposed downstream of the condenser 204. Additionally, an expansion device 208 may be utilized to expand the refrigerant-thus further reducing the pressure of the refrigerant-leaving condenser 204 before being flowed to evaporator 210. Evaporator 210 generally transfers heat from ambient air passing over the evaporator 210 to refrigerant flowing through evaporator 210, thereby cooling the air and causing the refrigerant to vaporize. An evaporator fan 212 may be used to force air over evaporator 210 as illustrated. As such, cooled air is produced and supplied to refrigerated compartments 12, 14 of refrigerator appliance 10. In certain embodiments, evaporator fan 212 can be a variable speed evaporator fan, such that the speed of fan 212 may be controlled or set anywhere between and including, for example, zero (0) and one hundred (100) percent. The speed of evaporator fan 212 can be determined by, and communicated to, evaporator fan 212 by controller 11.

Turning now generally to FIGS. 3 through 6, in some embodiments, a phase separator 310 is provided in fluid communication with refrigeration system 200 (e.g., along the path of refrigerant motivated by compressor 202) (FIG. 2). In certain embodiments, one or both of condenser 204 and evaporator 210 may include or be provided as phase separator 310. For instance, one phase separator 310 may be provided at condenser 204. Additionally or alternatively, another phase separator 310 may be provided at evaporator 210. Moreover, it is understood that additional or alternative configurations would be necessarily encompassed by the present disclosure. Although unique exemplary embodiments are described with respect to FIGS. 3 through 4 and FIGS. 5 through 6, it is understood that such embodiments are non-limiting and non-exclusive. Identical reference numerals are thus used to identify common elements. As would be understood, additional or alternative embodiments may include one or more features of the below-described embodiments.

Generally, phase separator 310 includes a separator body 312 defining a refrigerant cavity 314. In particular, an inner face 316 defines refrigerant cavity 314 within separator body 312. An outer face 318 of separator body 312 is formed opposite inner face 316 and is directed outward or away from refrigerant cavity 314. As will be described in detail below, at least a portion of outer face 318 may include a static shear surface 320.

A fluid inlet 322 and a fluid outlet 324 are generally defined through separator body 312. Both inlet 322 and outlet 324 are in fluid communication with refrigerant cavity 314. As shown, fluid inlet 322 is defined upstream from fluid outlet 324. When assembled, both fluid inlet 322 and fluid outlet 324 are in fluid communication with refrigeration system 200 (e.g., along the path of refrigerant motivated by compressor 202) (FIG. 2). During operations, fluid refrigerant may thus flow (as indicated at arrows 326) through fluid inlet 322 and into refrigerant cavity 314 before exiting fluid outlet 324. In the case of phase separator 310 as a condenser (e.g., condenser 204-FIG. 2), fluid refrigerant 326 may enter fluid inlet 322 as a compressed gas (e.g., from compressor 202) and exit fluid outlet 324 as a liquid (e.g., upstream from evaporator 210 or expansion device 208-FIG. 2). In the case of phase separator 310 as an evaporator (e.g., evaporator 210), fluid refrigerant 326 may enter fluid inlet 322 as a liquid (e.g., from condenser 204 or expansion device 208) and exit fluid outlet 324 as a gas (e.g., upstream from compressor 202).

As shown, a rotatable heat exchanger 330 may be provided near or adjacent to phase separator 310. Generally, rotatable heat exchanger 330 includes a thermally conductive body 332 (e.g., formed from one or more conductive materials, such as aluminum, copper, or tin, as well as alloys thereof). Moreover, rotatable heat exchanger 330 may define a rotation axis A about which thermally conductive body 332 rotates. An axial direction X may be defined parallel to the rotation axis A, and a radial direction R may be defined perpendicular to the rotation axis A (e.g., outward from the rotation axis A).

At least a portion of thermally conductive body 332 defines a dynamic shear surface 334 that is directed toward (i.e., faces) at least a portion of the outer face 318 of separator body 312. Generally, dynamic shear surface 334 can be moved or rotated relative to at least a portion of phase separator 310. For instance, thermally conductive body 332, including dynamic shear surface 334, may be rotated about rotation axis A without directing dynamic shear surface away from static shear surface 320. Thus, even as dynamic shear surface 334 rotates, dynamic shear surface 334 remains directed toward static shear surface 320.

In exemplary embodiments, conductive body 332, including dynamic shear surface 334, is operably connected (e.g., mechanically connected) to a suitable motor 336 (e.g., electro-magnetic motor). When assembled, motor 336 generally serves to motivate or rotate thermally conductive body 332 and dynamic shear surface 334 about the rotation axis A. In some such embodiments, one or more drive shafts 338 may connect motor 336 (e.g., directly or through one or more intermediate gear assemblies) to thermally conductive body 332.

Figure 4:
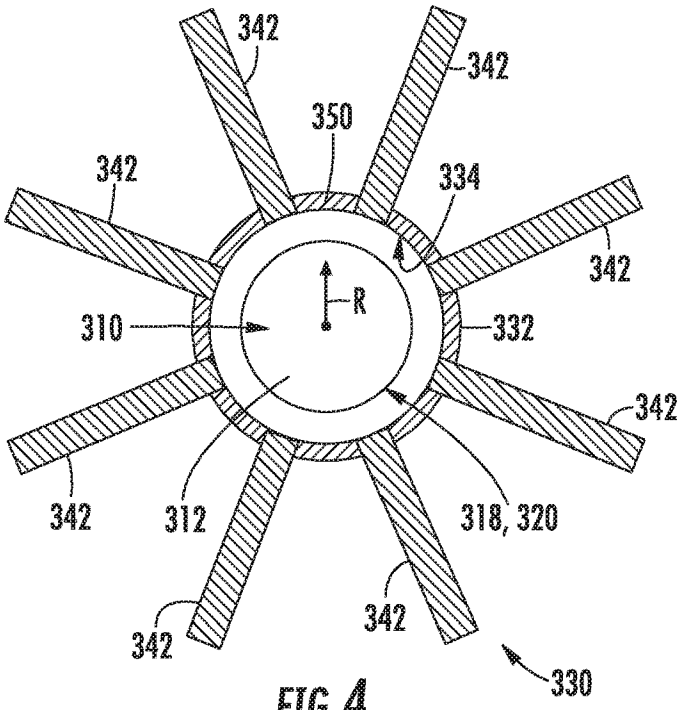
FIG. 4 provides a cross-sectional, schematic, top view of the exemplary embodiments of FIG. 3, taken along the lines 4-4.
Figure 3:
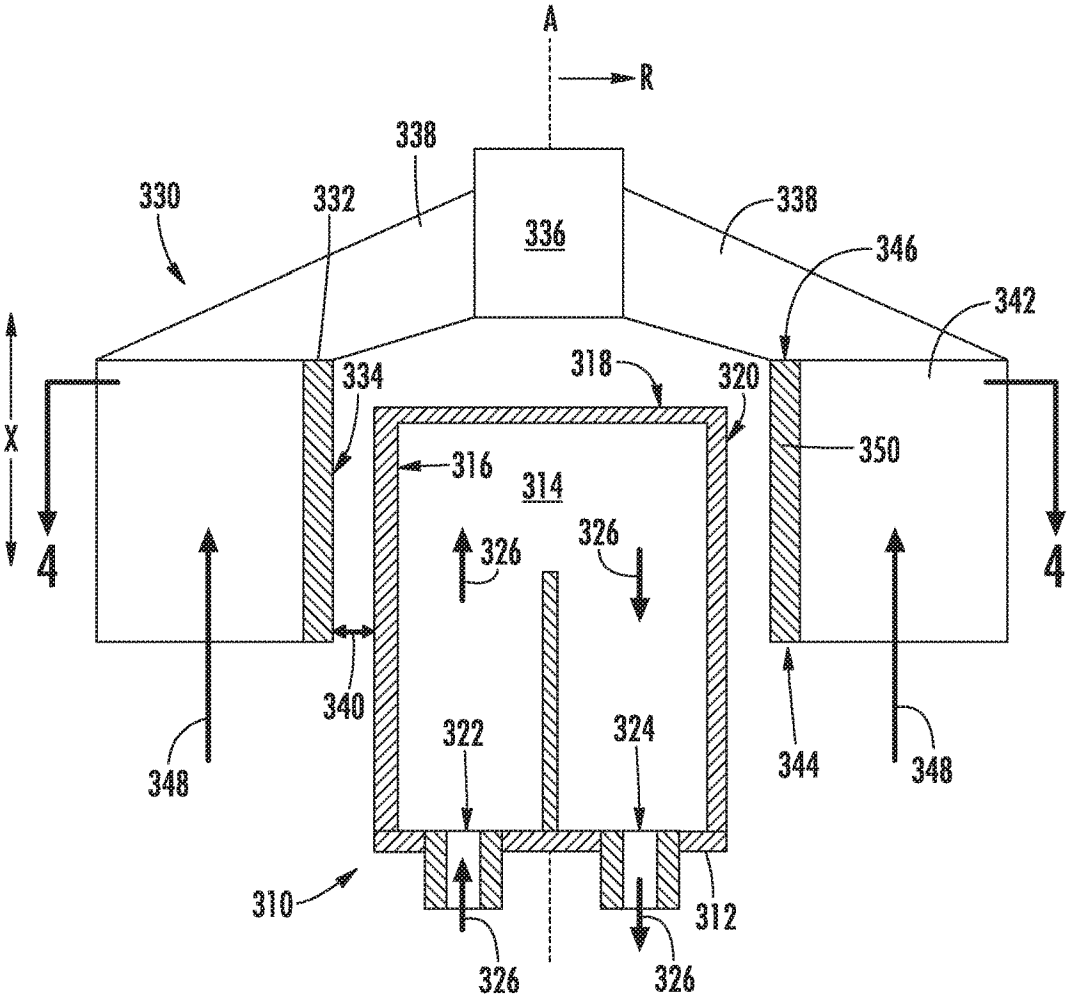
FIG. 3 provides a cross-sectional, schematic, side view of a portion of a sealed refrigeration system according to exemplary embodiments of the present disclosure.

Turning especially to FIGS. 3 and 4, in some embodiments, at least a portion of thermally conductive body 332 is spaced apart from phase separator 310 in or along the radial direction R. In particular, the dynamic shear surface 334 of the thermally conductive body 332 is spaced apart from the static shear surface 320 of the outer face 318 for the separator body 312. One or both of the dynamic shear surface 334 and the static shear surface 320 may be provided as a high-polish, non-permeable surface. A set fluid gap 340 may be defined in the space between the dynamic shear surface 334 and the static shear surface 320. In some embodiments, the fluid gap 340 is between 0.0005 inches and 0.005 inches. For instance, the fluid gap 340 may be defined as a distance (e.g., radial distance or length) of about 0.001 inches.

Although a fluid (e.g., air) may fill the spacing of fluid gap 340, the fluid gap 340 may be otherwise free of any solid intermediate members that might establish contact or conductive thermal communication between the dynamic shear surface 334 and the static shear surface 320. Thus, the dynamic shear surface 334 may rotate relative to the static shear surface 320 without either surface 334, 320 contacting the other. In some such embodiments, the fluid gap 340 is generally open to the ambient environment. Air may thus be permitted to pass between the ambient environment and the fluid gap 340 (e.g., along an axial opening). During use, rotation of thermally conductive body 332 may form a fluid film (e.g., air film) within the fluid gap 340. Advantageously, power density of the rotatable heat exchanger 330 may be significantly increased (e.g., by 200% to 500% in comparison to the rotatable heat exchanger 330 in a static or non-rotating state). Moreover, the rotatable heat exchanger 330 and thermally conductive body 332 may notably utilize a comparatively small size while maintaining sufficient exchange capacity. Additionally or alternatively, the efficiency at the phase separator 310 may be increased or improved.

As shown in FIGS. 3 and 4, certain embodiments include thermally conductive body 332 in a position that extends at least partially about phase separator 310. In some such embodiments, phase separator 310, including cavity 314, may extend along or about a portion of the rotation axis A. Dynamic shear surface 334 may thus be positioned radially outward from static shear surface 320. Fluid gap 340 may be defined as a radial distance. In some such embodiments, fluid gap 340 is maintained as a constant distance between dynamic shear surface 334 and static shear surface 320 (e.g., a constant radial distance along a portion of the axial direction X between a top end and bottom end of separator body 312). For instance, dynamic shear surface 334 may be a cylindrical surface formed about phase separator 310. A portion of outer surface 318 (e.g., static shear surface 320) may be matched as a corresponding cylindrical surface (e.g., having a smaller diameter than the cylindrical surface of dynamic shear surface 334). Thus, the static shear surface 320 may be a cylindrical surface of phase separator 310. Moreover, at least a portion of separator body 312 may be nested within—and coaxial with—a portion of thermally conductive body 332.

In exemplary embodiments, a plurality of fins 342 is provided on rotatable heat exchanger 330. As shown in FIGS. 3 and 4, the fins 342 may extend in the radial direction R from thermally conductive body 332 (e.g., away from the fluid gap 340). Moreover, the fins 342 may be in conductive thermal communication with thermally conductive body 332. For instance, one or more of the fins 342 may be integral with thermally conductive body 332 (e.g., formed as a unitary monolithic member with thermally conductive body 332). Additionally or alternatively, one or more of the fins 342 may be separably attached to (e.g., in direct or indirect contact with) thermally conductive body 332. Moreover, the fins 342 may be formed from a conductive material that is the same or different from the material of thermally conductive body 332 (e.g., aluminum, copper, or tin, as well as alloys thereof).

As further illustrated in FIGS. 3 and 4, the fins 342 may also extend generally along the axial direction X (e.g., parallel to the axial direction X or, alternatively, at a non-orthogonal angle thereto) from a first end 344 of the thermally conductive body 332 to a second end 346 of the thermally conductive body 332. As an example, the fins 342 may be formed as discrete linear plates extending from a cylindrical wall 350 of the thermally conductive body 332. When assembled, the linear plates may be parallel to the axial direction X. As another example, the fins 342 may be formed as discrete airfoils having a gradual curve relative to the axial direction X, as would be generally understood. As rotatable heat exchanger 330 is rotated, the fins 342 may similarly rotate about the rotation axis A. In some embodiments, the plurality of fins 342 is provided as a plurality of fan blades. Thus, the fins 342 may generate an airflow (as indicated at arrows 348) across the rotatable heat exchanger 330 (e.g., on the cylindrical wall 350 opposite the dynamic shear surface 334). In some such embodiments, the airflow 348 is exhausted from the rotatable heat exchanger 330 perpendicular to the radial distance of the fluid gap 340. In embodiments, wherein the rotatable heat exchanger 330 has a cylindrical shape (e.g., at the dynamic shear surface 334), the airflow 348 may be exhausted parallel to the axial direction X. Thus, as illustrated in FIG. 3, rotatable heat exchanger 330 may define an airflow exhaust direction parallel to the rotation axis A.

Figure 6:
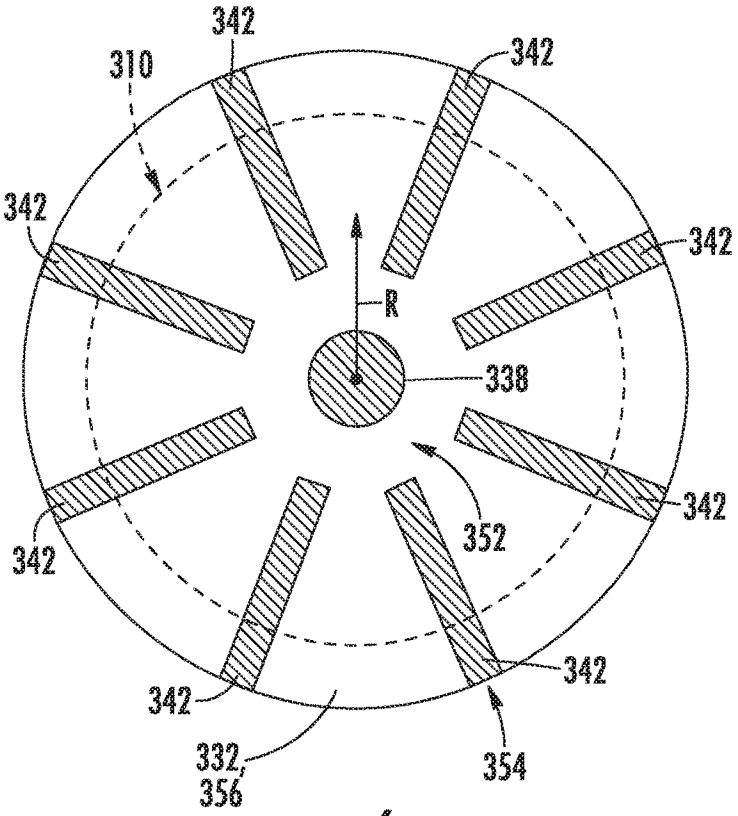
FIG. 6 provides a cross-sectional, schematic, top view of the exemplary embodiments of FIG. 5, taken along the lines 6-6.
Figure 5:
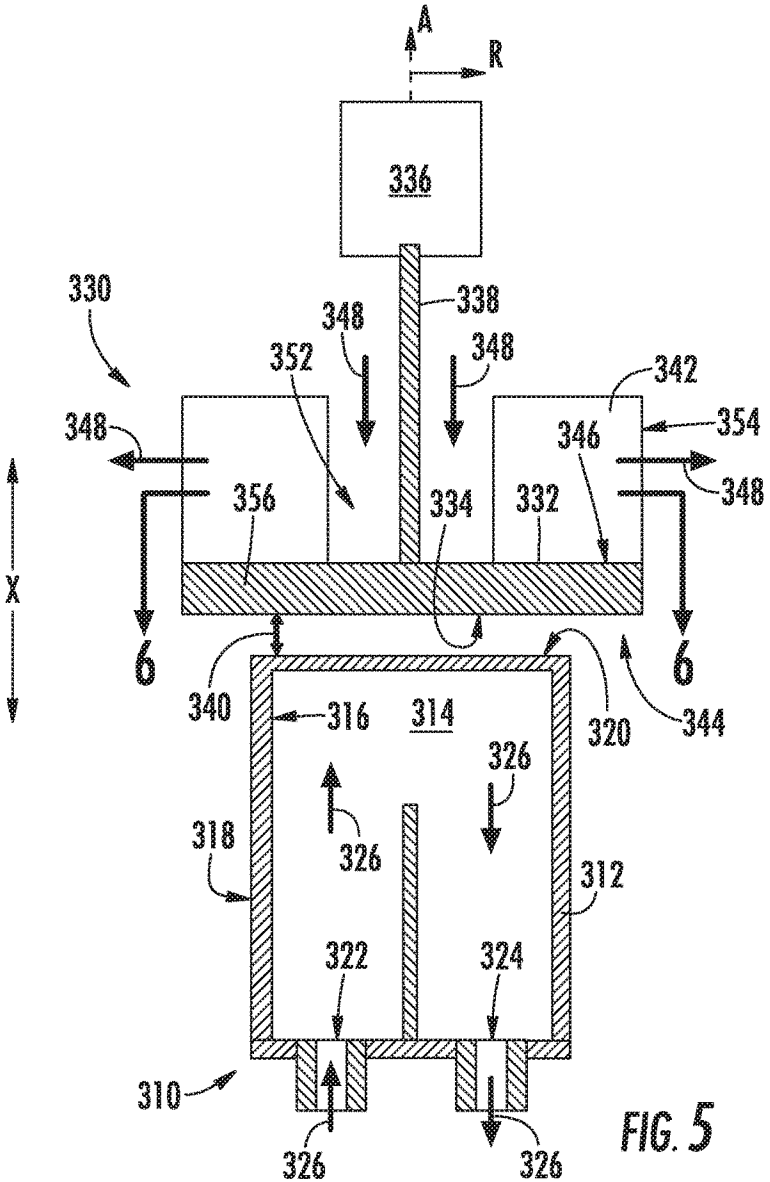
FIG. 5 provides a cross-sectional, schematic, side view of a portion of a sealed refrigeration system according to exemplary embodiments of the present disclosure.

Turning especially to FIGS. 5 and 6, in some embodiments, at least a portion of thermally conductive body 332 is spaced apart from phase separator 310 in or along the axial direction X. In particular, the dynamic shear surface 334 of the thermally conductive body 332 is spaced apart from the static shear surface 320 of the outer face 318 for the separator body 312. One or both of the dynamic shear surface 334 and the static shear surface 320 may be provided as a high-polish, non-permeable surface. A set fluid gap 340 may be defined in the space between the dynamic shear surface 334 and the static shear surface 320. In some embodiments, the fluid gap 340 is between 0.0005 inches and 0.005 inches. For instance, the fluid gap 340 may be defined as a distance (e.g., axial distance or length) of about 0.001 inches.

Although a fluid (e.g., air) may fill the spacing of fluid gap 340, the fluid gap 340 may be otherwise free of any solid intermediate members that might establish contact or conductive thermal communication between the dynamic shear surface 334 and the static shear surface 320. Thus, the dynamic shear surface 334 may rotate relative to the static shear surface 320 without either surface 334, 320 contacting the other. In some such embodiments, the fluid gap 340 is generally open to the ambient environment. Air may thus be permitted to pass between the ambient environment and the fluid gap 340 (e.g., along a radial opening). During use, rotation of thermally conductive body 332 may form a fluid film (e.g., air film) within the fluid gap 340. Advantageously, power density of the rotatable heat exchanger 330 may be significantly increased (e.g., by 200% to 500% relative to the rotatable heat exchanger 330 in a static or non-rotating state). Moreover, the rotatable heat exchanger 330 and thermally conductive body 332 may notably utilize a comparatively small size while maintaining sufficient exchange capacity. Additionally or alternatively, the efficiency at the phase separator 310 may be increased or improved.

As shown in FIGS. 5 and 6, certain embodiments include thermally conductive body 332 in a position that extends at least partially along a direction perpendicular to the rotation axis A (e.g., along the radial direction R) at a position spaced apart from phase separator 310. In some such embodiments, phase separator 310, including cavity 314, may extend along or about a portion of the rotation axis A and outward therefrom along the radial direction R. Dynamic shear surface 334 may be spaced apart from static shear surface 320 along the rotation axis A or axial direction X. Fluid gap 340 may thus be defined as an axial distance. In some such embodiments, fluid gap 340 is maintained as a constant distance between dynamic shear surface 334 and static shear surface 320 (e.g., a constant axial distance along a portion of the radial direction R). For instance, dynamic shear surface 334 may be a flat or planar surface perpendicular to the rotation axis A above or below phase separator 310. A portion of outer surface 318 (e.g., static shear surface 320) may be matched as a corresponding planar surface parallel to the planar surface of dynamic shear surface 334. Thus, the static shear surface 320 may be a planar surface of phase separator 310. If the planar surface of the dynamic shear surface 334 forms a circular plane, the planar surface of the static shear surface 320 may form a coaxial parallel circular plane (e.g., having a diameter greater than, equal to, or less than the diameter of circular plane for the dynamic shear surface 334).

In exemplary embodiments, a plurality of fins 342 is provided on rotatable heat exchanger 330. As shown in FIGS. 5 and 6, the fins 342 may extend in the axial direction X from thermally conductive body 332 (e.g., away from the fluid gap 340). In some such embodiments, an air intake 352 is formed about the rotation axis A and the plurality of fins 342 are positioned about the air intake 352. The fins 342 may be in conductive thermal communication with thermally conductive body 332. For instance, one or more of the fins 342 may be integral with thermally conductive body 332 (e.g., formed as a unitary monolithic member with thermally conductive body 332). Additionally or alternatively, one or more of the fins 342 may be separably attached to (e.g., in direct or indirect contact with) thermally conductive body 332. Moreover, the fins 342 may be formed from a conductive material that is the same or different from the material of thermally conductive body 332 (e.g., aluminum, copper, or tin, as well as alloys thereof).

As further illustrated in FIGS. 5 and 6, the fins 342 may also extend generally along the radial direction R (e.g., parallel to the radial direction R or, alternatively, at a non-orthogonal angle thereto) from air intake 352 to a radial perimeter 354 of thermally conductive body 332). As an example, the fins 342 may be formed as discrete linear plates extending from a platen base 356 at the second end 346 of the thermally conductive body 332. When assembled, the linear plates may extend along the radial direction R. As another example, the fins 342 may be formed as discrete impeller blades having a gradual curve relative to the radial direction R, as would be generally understood. As rotatable heat exchanger 330 is rotated, the fins 342 may similarly rotate about the rotation axis A. In some embodiments, the plurality of fins 342 is provided as a plurality of fan blades. Thus, the fins 342 may generate an airflow (as indicated at arrows 326) across the rotatable heat exchanger 330 (e.g., on the platen base 356 opposite the dynamic shear surface 334). In some such embodiments, the airflow 326 is exhausted from the rotatable heat exchanger 330 perpendicular to the axial distance of the fluid gap 340. In embodiments, wherein the rotatable heat exchanger 330 has a planar shape (e.g., at the dynamic shear surface 334), the airflow 326 may be exhausted along the radial direction R. Thus, as illustrated in FIG. 5, rotatable heat exchanger 330 may define an airflow exhaust direction perpendicular to the rotation axis A.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sealed refrigeration system comprising:

a compressor to compress a refrigerant fluid through the sealed refrigeration system;

a phase separator in fluid communication with the compressor, the phase separator comprising a separator body defining an inner face and an outer face, the inner face defining a refrigerant cavity within the phase separator body, and the outer face directed away from the refrigerant cavity opposite the inner face; and a rotatable heat exchanger comprising a thermally conductive body defining a dynamic shear surface directed toward the outer face of the separator body, wherein the rotatable heat exchanger defines and extends along a rotation axis and defines and extends along a radial direction extending outwardly from the rotation axis, wherein a set fluid gap is defined between the dynamic shear surface and the outer face along the radial direction, and wherein the dynamic shear surface is a cylindrical surface formed about the refrigerant cavity radially outward from the refrigerant cavity such that the set fluid gap is disposed further outward from the rotation axis along the radial direction than the refrigerant cavity and the outer face to nest the separator body within the thermally conductive body.

2. The sealed refrigeration system of claim 1, wherein the rotatable heat exchanger comprises a plurality of fins extending away from the set fluid gap.

3. The sealed refrigeration system of claim 2, wherein the plurality of fins extend from the thermally conductive body along the radial direction.

4. The sealed refrigeration system of claim 2, wherein the rotatable heat exchanger defines an axial direction extending in parallel to the rotation axis, and wherein the plurality of fins extend from the thermally conductive body along the axial direction.

5. The sealed refrigeration system of claim 1, wherein the set fluid gap is between 0.0005 inches and 0.005 inches.

6. The sealed refrigeration system of claim 1, wherein the rotatable heat exchanger defines an airflow exhaust direction parallel to the rotation axis.

7. A sealed refrigeration system comprising:

a compressor to compress a refrigerant fluid through the sealed refrigeration system;

a phase separator in fluid communication with the compressor, the phase separator comprising a separator body defining an inner face and an outer face, the inner face defining a refrigerant cavity within the phase separator body, and the outer face directed away from the refrigerant cavity opposite the inner face; and a rotatable heat exchanger comprising a thermally conductive body defining a dynamic shear surface directed toward the outer face of the separator body, wherein the rotatable heat exchanger defines and extends along a rotation axis and defines and extends along a radial direction extending outwardly from the rotation axis, wherein a set fluid gap is defined between the dynamic shear surface and the outer face along the radial direction, wherein the dynamic shear surface is a cylindrical surface formed about the refrigerant cavity radially outward from the refrigerant cavity such that the set fluid gap is disposed further outward from the rotation axis along the radial direction than the refrigerant cavity and the outer face to nest the separator body within the thermally conductive body, and wherein the rotatable heat exchanger further comprises a plurality of fins extending outward as a plurality of fan blades from the thermally conductive body and away from the set fluid gap.

8. The sealed refrigeration system of claim 7, wherein the plurality of fins extend from the thermally conductive body along the radial direction.

9. The sealed refrigeration system of claim 7, wherein the rotatable heat exchanger defines an axial direction extending in parallel to the rotation axis, and wherein the plurality of fins extend from the thermally conductive body along the axial direction.

10. The sealed refrigeration system of claim 7, wherein the plurality of fins extend radially outward from the cylindrical surface.

11. The sealed refrigeration system of claim 7, wherein the set fluid gap is between 0.0005 inches and 0.005 inches.

12. The sealed refrigeration system of claim 7, wherein the rotatable heat exchanger defines an airflow exhaust direction parallel to the rotation axis.

13. A refrigerator appliance, comprising:

a cabinet defining a chilled chamber; and a sealed refrigeration system mounted to the cabinet to cool the chilled chamber, the sealed refrigeration system comprising a compressor to compress a refrigerant fluid through the sealed refrigeration system, a phase separator in fluid communication with the compressor, the phase separator comprising a separator body defining an inner face and an outer face, the inner face defining a refrigerant cavity within the phase separator body, and the outer face directed away from the refrigerant cavity opposite the inner face, and a rotatable heat exchanger comprising a thermally conductive body defining a dynamic shear surface directed toward the outer face of the separator body, wherein the rotatable heat exchanger defines and extends along a rotation axis and defines and extends along a radial direction extending outwardly from the rotation axis, wherein a set fluid gap is defined between the dynamic shear surface and the outer face along the radial direction, wherein the dynamic shear surface is a cylindrical surface formed about the refrigerant cavity radially outward from the refrigerant cavity such that the set fluid gap is disposed further outward from the rotation axis along the radial direction than the refrigerant cavity and the outer face to nest the separator body within the thermally conductive body, wherein the rotatable heat exchanger defines an airflow exhaust direction parallel to the rotation axis, and wherein the set fluid gap is maintained as a constant radial distance along an axial direction parallel to the rotation axis.

* * * * *